United States Patent [19]

Brouhard, Jr.

[11] 4,184,777

[45] Jan. 22, 1980

[54] AGITATOR

[76] Inventor: Wayne R. Brouhard, Jr., 2026 Harrison, Apt. 2, Davenport, Iowa 52803

[21] Appl. No.: 755,662

[22] Filed: Dec. 30, 1976

[51] Int. Cl.[2] ..... B01F 11/00; G03D 3/04

[52] U.S. Cl. ..... 366/211; 366/237; 354/327

[58] Field of Search ..... 259/13, 100, 29, 56, 259/72, 75; 134/121; 354/327, 328; 74/25, 37, 55; 366/187, 210, 211, 236, 237, 276

[56] References Cited

U.S. PATENT DOCUMENTS

| | | | |
|---|---|---|---|
| 2,104,283 | 1/1938 | Webster | 259/75 |
| 2,545,914 | 3/1951 | Boucher | 259/75 |
| 2,863,475 | 12/1958 | Lau | 259/72 |
| 3,935,884 | 2/1976 | Hazelton | 259/72 |
| 4,026,531 | 5/1977 | Luchsinger et al. | 366/211 |

*Primary Examiner*—Harvey C. Hornsby
*Assistant Examiner*—Timothy F. Simone
*Attorney, Agent, or Firm*—R. L. Hollister

[57] ABSTRACT

An agitator for use in developing photographic film has an upright oscillatable shaft with a platform at its upper end for supporting a developing tank, spring means urging the upright shaft to a neutral position, a motor-driven shaft normal to the upright shaft, a pair of radial arms carried by the motor-driven shaft, and a pair of vertically spaced arms carried by the upright shaft and extending across the path of movement of the radial arms. Upon rotation of the motor-driven shaft a first radial arm contacts a first spaced arm and rotates the upright shaft from its neutral position. When the first radial arm passes by the first spaced arm the spring means returns the upright shaft toward its neutral position until the first spaced arm strikes the second radial arm. The second radial arm then acts on the first spaced arm to rotate the upright shaft away from the neutral position. When the second radial arm passes by the first spaced arm the spring means returns the upright shaft to the neutral position through a series of diminishing arcs. Continued rotation of the motor-driven shaft results in the radial arms acting on the second spaced arm to cause a similar but opposite action. The oscillating and jarring action of the upright shaft keeps the developing solution well mixed and keeps the film being developed free of air bubbles.

4 Claims, 4 Drawing Figures

AGITATOR

BACKGROUND OF THE INVENTION

The present invention relates generally to liquid agitators, and more particularly relates to agitators for use in developing photographic film.

When developing photographic film it is necessary to keep the developing solution properly mixed in order to obtain sharp, properly shaded pictures. If the developing solution is mixed or agitated too little, the film becomes cloudy. If the developing solution is agitated too much the developing process takes place too rapidly and the film becomes dark such that midtones or shading is lost. This need for proper agitation of the developing solution requires, in the absence of some automatic apparatus for agitating the solution, almost constant supervision during the developing process.

Numerous attempts have been made to provide devices for agitating developing solution which did not require constant supervision, but for various reasons these have met with only limited success. One such prior art device is shown in U.S. Pat. No. 2,104,283 which issued to Robert A. Webster on Jan. 4, 1938. This patent discloses a reversible motor driving an upright shaft which carries a tray at its upper end to support a developing tank. According to this patent, the oscillating motion of the shaft keeps the solution well mixed and the sudden reversing motion at the end of each power stroke of the reversible motor causes a washing action on the film to remove any gas bubbles which may have adhered to the film. The principle disadvantage with this device is that it is constantly agitating the developing solution and this can easily result in over-agitation.

Another prior art agitator is disclosed in U.S. Pat. No. 2,545,914 which issued to H. F. Boucher on Mar. 20, 1951. This patent discloses a device which constantly oscillates a film reel within a developing tank. However, if the film reel is oscillated fast enough to insure that gas bubbles adhering to the film are removed, the constant oscillation will result in over-agitation.

Still another prior art agitator is disclosed in U.S. Pat. No. 2,493,441 which issued to W. H. Carr, Jr., on Jan. 3, 1950. This patent discloses an agitator which imparts an intermittent rocking motion to a developing tank. That is, the developing tank is oscillated about a horizontal axis rather than an upright axis. However, experience has shown the gentle agitation resulting from oscillation about an upright axis provides better results than the relatively violent agitation caused by oscillation about a horizontal axis.

SUMMARY OF THE INVENTION

A principle object of the present invention is to provide a liquid agitator which intermittently oscillates a liquid container about an upright axis.

Another object of the present invention is to provide a liquid agitator which intermittently oscillates a liquid container about an upright axis and which, at predetermined times, temporarily abruptly stops movement of the container.

A further object of the invention is to provide an agitator for use in developing film which keeps the developing solution properly mixed without constant supervision by intermittently oscillating the developing tank about an upright axis.

Still another object of the invention is to provide an agitator for use in developing film which keeps the film free of air bubbles and the solution properly mixed without constant supervision by intermittently oscillating the developing tank about an upright axis and periodically imparting a jarring action on the developing tank.

A still further object of the invention is to provide a liquid agitator which is simple in construction and use, durable, and capable of being produced sufficiently economically to be affordable by the typical photography enthusiast.

The foregoing objects are obtained and the disadvantages of prior art agitators are overcome by providing an agitator which includes an upright oscillatable shaft which is spring-biased to a neutral position and is adapted to support a developing tank at its upper ind, a motor-driven shaft normal to the upright shaft and carrying a pair of radial arms, and a pair of vertically spaced arms carried by the upright shaft extending across the path of movement of the radial arms. With these few simple main components arranged as stated, the agitator of the present invention provides a gentle and intermittent agitation to developing solution within a tank supported by the upright shaft to keep the solution properly mixed, and, at the same time, imparts an occasional jarring action on the tank to knock free any gas bubbles which might have adhered to the film being developed.

The above and additional objects and advantages of the present invention will become apparent to those skilled in the art from a reading of the following detailed description of one preferred embodiment of the invention when taken in conjunction with the accompanying drawing.

DESCRIPTION OF THE PREFERRED EMBODIMENT

Figure 2:
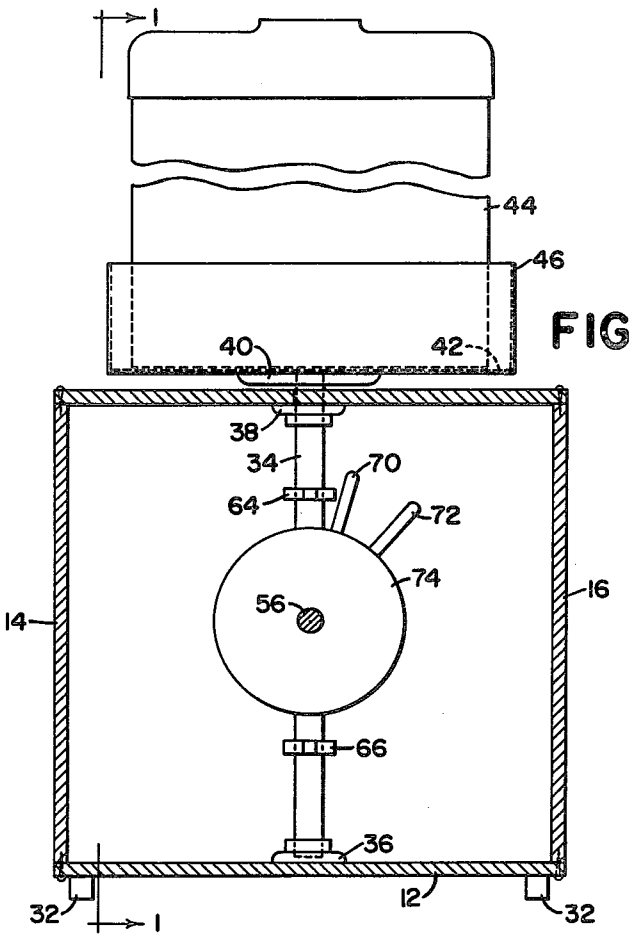
FIG. 2 is cross-sectional view along the line 2—2 of FIG. 1.
Figure 4:
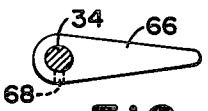
FIG. 4 is a cross-sectional view along line 4—4 of FIG. 1.
Figure 1:
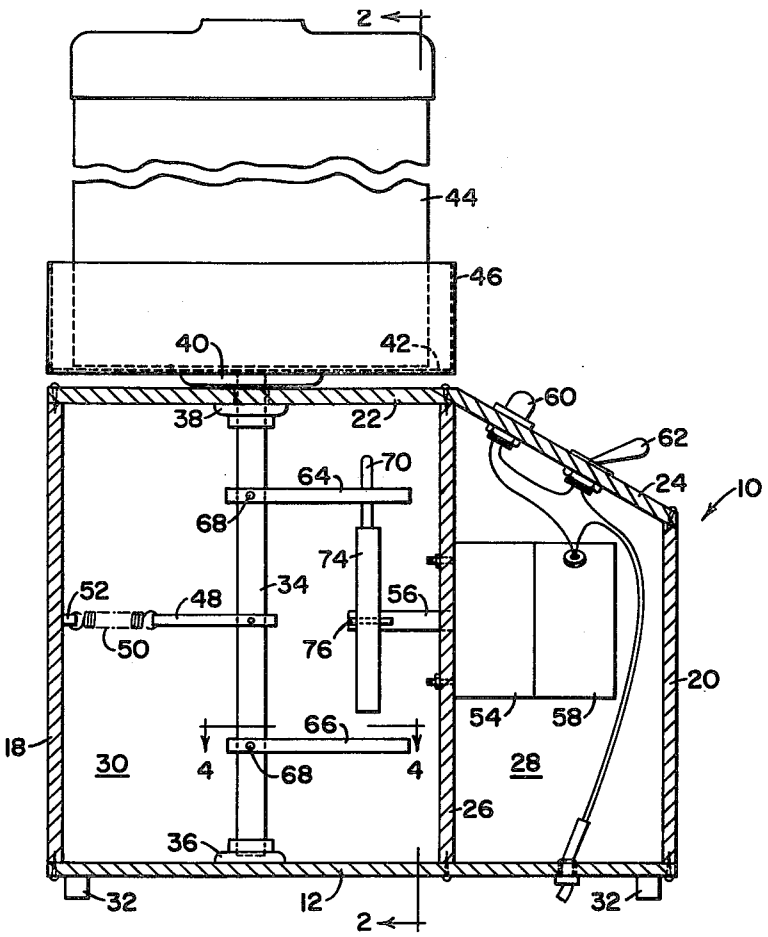
FIG. 1 is a perspective view of the agitator of the present invention.
Figure 3:
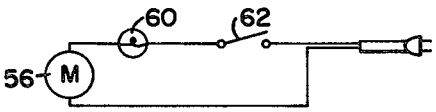
FIG. 3 is a schematic showing of the electric control circuit of the present invention.

A preferred embodiment of the invention is illustrated in the drawing and includes an enclosed housing indicated generally as 10. The housing 10 includes a bottom wall 12, a pair of side walls 14 and 16, a rear wall 18, a front wall 20 and first and second top walls 22 and 24. A partition 26 divides the housing into a motor chamber 28 and an actuating mechanism chamber 30. The housing is supported at each of its corners by a resilient pad 32 made of rubber or other suitable material.

The lower end of an upright shaft 34 is supported by and journaled in a suitable bearing 36 which is mounted on the bottom wall 12 of the housing 10 in approximately a central position in the mechanism chamber. The shaft 34 extends upwardly through a bearing 38 secured to the top wall 22 of the housing and through the top wall 22. A rigid base member or spider 40 is secured to the upper end of the shaft 34 externally of the housing and serves to mount a support or platform member 42 on the upper end of the shaft 34. The platform member 42 is adapted to receive a suitable photographic film developing tank 44 and is provided with an upwardly extending wall 46 which will catch any developing solution which accidentally spills from the tank 44 and which will prevent the tank 44 from falling off the platform.

A spring arm 48 is secured to the shaft 34 internally of the housing and a coil spring 50 is anchored between the free end of the arm 48 and a lug 52 secured to the rear wall 18. Thus, although the bearings 36 and 38 would permit the shaft 34 to rotate, the arm 48 and spring 50 limit the movement of the shaft 34 to oscillation and bias the shaft 34 to a neutral position.

A reduction gear set 54 is positioned within the motor chamber and secured to the partition 26. An output shaft 56 of the gear set 54 extends through the partition 26 substantially normal to the upright shaft 34. A small electric motor 58 is secured to the gear set 54 and drives the input to the gear set. The motor and gear set combination for the preferred embodiment were chosen so that the output shaft 56 is driven at approximately one revolution per minute. The motor 58 is a simple 110 volt A.C. motor which is wired in series with a signal light 60 and a suitable switch such as the toggle switch 62.

A pair of upper and lower vertically spaced striker arms 64 and 66 are mounted on the upright shaft 34 and held in adjusted positions by set screws 68. The striker arms 64 and 66 are positioned equal distances above and below, respectively, the axis of the output shaft 56 and extend substantially parallel to the axis of the output shaft when the upright shaft 34 is in its neutral position.

The output shaft drives a pair of first and second cam arms 70 and 72 which extend radially from the outer end of the output shaft 56. The cam arms 70 and 72 are threaded or press fit into suitable openings provided in the periphery of a disk 74 held on the shaft 56 by a key 76.

Although the following dimensions can be varied, in the preferred embodiment of the invention the cam arms 70 and 72 are positioned to form an acute angle of from 15 to 20 degrees. The cam arms, when in a vertical position, extend beyond the striker arms by approximately one-half of an inch and contact the striker arms approximately one inch from the shaft 34.

To use the above-described agitator, the tank 44 is loaded with the film to be developed and a suitable developing solution. The tank 44 is then placed on the platform 42 and the switch moved to its "on" position. The motor 58, through the gear set 54 and output shaft 56, slowly drives the disk 74 in a counterclockwise direction as seen in FIG. 2. As the disk 74 turns, the first cam arm 70 bears against the upper striker arm 64 and rotates the upright shaft 34, and hence the platform 42 nd tank 44, in a clockwise direction as viewed from the top against the force of the spring 50. After the shaft 34 has been rotated through a predetermined arc, the striker arm 64 passes over the outer end of the cam arm 70 and the spring 54 rotates the upright shaft back toward its neutral position. Before the upright shaft 34 reaches its neutral position, the striker arm 64 strikes sharply against the cam arm 72 which has moved to the upright position. The resulting jarring action dislodges any gas bubbles which might have adhered to the film.

Continued rotation of the disk 74 causes the cam arm 72 to bear against the upper striker arm and again rotate the upright away from its neutral position. After the upright shaft 34 has been rotated through a predetermined arc the striker arm 64 passes over the outer end of the cam arm 72 and the spring 50 causes the upright shaft, and hence the tank 44, to oscillate through a series of diminishing arcs until the upright shaft 34 settles in its neutral position. This oscillation through a series of diminishing arcs gently agitates the developing solution in the tank 44.

Upon continued rotation of the disk 74 the cam arms reach and cooperate with the lower striker arm 66 to cause a similar action but in an opposite direction.

With the output shaft 56 rotating at approximately one revolution per minute and the striker and cam arms dimensioned as indicated above, agitation will occur between 15 and 20 seconds per minute. Of course, variations in dimensions will cause variations in the time of agitation and will cause variations in the agressiveness of the agitation. It should also be noted that the dimensions can be varied so that, rather than the striker arms passing over the outer ends of the cam arms, the cam arms pass by the outer ends of the striker arms.

Having illustrated and described a preferred embodiment of the invention, various modifications within the spirit and scope of the invention will become apparent to those skilled in the art and such modifications can be incorporated in the invention without departing from the underlying principles of the invention. Therefore, the invention should not be limited by the specific illustration and description, but only by the following claims.

I claim:

1. An agitator comprising: a frame; an upright shaft supported on the frame for oscillatory movement; a support member secured to the upper end of the upright shaft; a motor driven shaft supported by the frame substantially normal to the upright shaft; a first cam arm fixed to the motor-driven shaft and extending substantially radially therefrom; first and second striker arms fixed to the upright shaft equal distances from and on opposite sides of the motor driven shaft and extending substantially radially therefrom across the path of movement of the cam arm; yieldable means biasing the upright shaft to a neutral position; and a second radially-extending cam arm fixed to the motor-driven shaft and forming an acute angle with the first cam arm such that, when the first cam arm bears against one of the striker arms to rotate the upright shaft from its neutral position and then passes by the one of the striker arms, the yieldable means in returning the upright shaft to its neutral position causes the striker arm to strike the second cam arm.

2. An agitator comprising: a container; an upright shaft journaled in the container for oscillatory movement and extending externally of the container; a support plate fixed to the upper end of the upright shaft external of the container; motor means secured to the container internally thereof and having an output shaft substantially normal to the upright shaft; a pair of cam arms carried by the driven shaft and extending radially therefrom at an acute angle with respect to each other; a pair of vertically-spaced striker arms secured to the upright shaft internally of the housing and extending outwardly therefrom across the path of movement of the cam arms at substantially equal distances from the output shaft; a spring arm secured to the upright shaft; and spring means tensioned between the free end of the spring arm and a wall of the container yieldably resisting movement of the upright shaft and biasing the upright shaft to a neutral position.

3. The invention as set forth in claim 2 wherein said motor means comprises an electric motor and a reduction gear set, the electric motor driving the reduction gear set and the output shaft being the output shaft of the reduction gear set.

4. The invention as set forth in claim 3 wherein the striker and cam arms are so arranged with respect to each other that the output shaft will rotate through an arc approximately equal to the angle between the cam arms while the lead cam arm is in contact with either of the striker arms.

* * * * *